United States Patent [19]

Pan

[11] 4,407,854

[45] Oct. 4, 1983

[54] MANUFACTURE OF CABLE CORES

[75] Inventor: Ali Pan, Ontario, Canada

[73] Assignee: Northern Telecom Limited, Montreal, Canada

[21] Appl. No.: 247,127

[22] Filed: Mar. 24, 1981

[51] Int. Cl.[3] ..... H01B 13/16

[52] U.S. Cl. ..... 427/49; 427/120; 427/318; 427/434.7; 156/48; 174/25 P; 174/26 R

[58] Field of Search ..... 156/48, 273, 145; 427/49, 52, 120, 318, 434.6, 434.7, 8; 118/DIG. 19; 219/76.17, 209, 300; 174/25 P, 26 R; 307/147

[56] References Cited

U.S. PATENT DOCUMENTS 1,760,583 5/1930 Clark ..... 427/49
2,063,346 12/1936 Scott et al. ..... 156/48
2,081,803 5/1937 Ell ..... 307/147
2,534,935 12/1950 Wagner ..... 174/146

FOREIGN PATENT DOCUMENTS 1153430 8/1963 Fed. Rep. of Germany .... 174/25 P

*Primary Examiner*—John D. Smith
*Assistant Examiner*—Bernard F. Plantz
*Attorney, Agent, or Firm*—R. J. Austin

[57] ABSTRACT

Heat treating stranded together conductors in a reeled condition by passing electrical current along a path through some of the conductors in one direction around the reel and then through other conductors in the opposite direction around the reel. In preferred methods, the current is passed in one direction through one half of the conductors and then in the opposite direction through the other half.

2 Claims, 3 Drawing Figures

MANUFACTURE OF CABLE CORES

This invention relates to the manufacture of cores for telecommunications cable.

In telecommunications cables which are to be buried, precautions are taken to prevent or resist water ingress into the cable cores. These precautions involve the use of impermeable polymeric cable jackets and metal sheaths within the jackets. They also include the filling of interstices in cable cores with grease, jelly or waxlike substances to prevent moisture flow into and along the cores in the event of leakage paths being formed through jackets and sheaths. When cable cores do not exceed a certain diameter and do not exceed a certain number of conductor pairs, the completed cores are fed, in a one pass operation, through pressurized chambers of these filling substances to force the substances under pressure into the interstices. Unfortunately, the filling process may not be as complete and uniform as is desirable because the filling substance tends to harden during passage between the insulated conductors and this resists further filling. Incomplete and non-uniformly filled cable deleteriously affects its telecommunication properties. For instance, presence of the filling substance between the insulated conductors is relied upon to increase the dielectric strength of the insulation. Lack of the filling substance in certain regions, therefore does not result in achieving the required dielectric effect.

Where cable cores are of larger diameters, it may be impossible to force the pressurized filling substances right into the core centres because of the increase in resistance to passage of the substances as distance increases from the core surfaces. In such cases, each core is normally made from a plurality of core units in each of which, pairs of insulated conductors are stranded together before the units themselves are stranded together to form the core. With these multi-unit cores, it is necessary to fill each core unit by immersion in pressurized filling substance before the units are combined into the core and then the core is immersed to fill the interstices between the units. The procedure for multi-unit core may result in an incomplete and non-uniform fill in each core unit similar to that outlined above for cores. In addition, however, it has further disadvantages. The filling of the core units and then of a completed core requires multiple passes through the filling substance. For continuous production, this requires an individual pressurized bath of filling substance for each core unit and then for the completed core. The floor space requirement is large because of the number of baths and core units issuing from their individual baths are covered in the greasy filling substance and this results in a messy operation. Alternatively, if less baths were used, core units would need to be reeled after filling and removed from the stranding apparatus to await stranding of the units together into a core. As may be appreciated, the reeling, removal for storage and unreeling of the accumulated reeled and filled units would also be an extremely messy operation.

The present invention provides a treatment for cable core or core units which assists in avoiding or lessening the above problems.

Accordingly, the present invention provides a method of treating a stranded construction of a plurality of stranded together insulated conductors for telecommunications cable comprising heating the stranded construction with it in a reeled condition by passing an electrical current along a path into a first group of the conductors at one end of the core, along said first group around the reel in one direction to the other end of the reel, into a second group of the conductors electrically connected to the first group at said other end of the core, and along the second group of the conductors around the reel in the opposite direction and to said one end of the core, heat in the conductors flowing into the insulation to increse the temperature at the outer surface of the insulation.

Heating of the conductors in the above manner before passage of the stranded construction through a pressurized filling substance which has a flowing capability which increases with increase in temperature, obviously affects the flowability when the filling substance contacts the pre-heated insulation of the conductors. As the substance is caused to flow into the interstices, a more complete and more uniform filling results than is found when interstices are filled between unheated insulation.

By passing the current along its path along a first group of conductors in one direction around the reel and then in the other direction along the second group, this is particularly advantageous for the heating process.

Flow of a DC current in the two opposite directions serves to reduce or cancel out any magnetization effects which would be created if flow was solely in one direction through the stranded construction, as a magnetic field would be established around the reel. For this reason, it is preferred for the number of conductors in the two groups to be exactly equal so that the magnetic effects in one group substantially equal the opposite magnetic effects of the other group. Clearly, for heating purposes, all of the insulated conductors are divided equally between the two groups.

Where the current is AC, a more uniform heating is provided throughout the length of the stranded construction than is possible with the current passing solely in one direction through the reel. Also, with an AC current passing along the path defined according to the invention, hot spots in the conductors are avoided. Such hot spots would exist with an AC current passing solely in one direction and could deleteriously affect the insulation and the telecommunications properties.

According to the above method, the stranded construction may comprise a cable core in which case, one pass of the heated core through pressurized filling substance is sufficient to thoroughly and substantially uniformly fill the interstices in the core. Of course, a stranded construction may be a core unit whereby the core unit is filled by passing it through a pressurized filling substance; then a plurality of units filled in this manner are combined into a core and the interstices between the units are filled. While core units are more completely and uniformly filled than with prior filling methods, the full advantage of the invention is not realized upon core units as distinct from a whole core because more than one pass through the filling substance is necessary.

The method of the invention is particularly advantageous for filling cable core with pressurized filling substance the flowability of which increases with increase in temperature. Before the invention, so far as is known to the inventor, a cable core having 400 pairs of insulated 26 gauge conductors could not be filled completely and uniformly. By the use of the method of heat treatment according to the invention, cable cores with 1800 pairs of insulated 26 gauge conductors have been filled substantially completely and uniformly in one pass through a pressurized filling substance. Also, a core with 1800 pairs of insulated 24 gauge conductors has been substantially completely and uniformly filled.

The invention also includes a reel of a stranded structure connected to electrical terminals for connection to a source of electrical power for heating purposes, the stranded structure comprising a plurality of stranded together insulated conductors for telecommunications cable, said conductors comprising first and second groups of conductors and the terminals comprising first and second terminals of opposite potential, the first group of conductors electrically connected to the first terminal and the second group of conductors electrically connected to the second terminal at one end of the stranded structure, and at the other end of the structure, the first group of conductors electrically connected to the second group of conductors.

Embodiments of the invention will now be described, by way of example, with reference to the accompanying drawings in which.

In each embodiment to be described, a cable core 10 mounted upon a reel 12 is heated by AC current in the manner now to be described. The cable core is of conventional construction and comprises a plurality of pairs of insulated conductors, the insulated conductors of each pair being twisted together in normal fashion and the cable core being formed by stranding together the twisted pairs. Dependent upon the number of pairs of conductors, the cable core will be composed of one or more units of stranded pairs and where several units are used, these are also twisted together.

Figure 1:
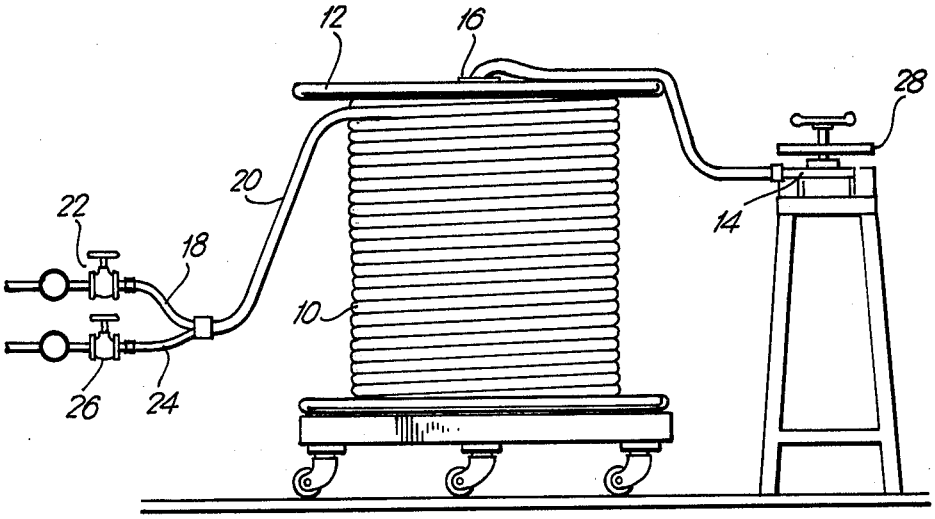
FIG. 1 is a side elevational view of a reeled cable connected to terminals for heating purposes.

As shown in FIG. 1, the cable is wrapped around the reel with its inner end 14 passing through a hole in a flange 16 of the reel in normal fashion to hold it in place for the reeling to take place.

The cable core is waiting to be passed through a conventional bath of pressurized and heated filling grease, jelly or wax for a core filling operation. Before passing it through the bath, however, the core itself is to be heated in the manner according to the invention. To do this, the conductors of the core are selected into first and second groups. The permutations of the conductors are numerous in formation of the groups but for convenience it is preferable to have both conductors of each pair in the same group. Each of the groups ideally comprises 50% of the conductors in the cable core.

After group selection, the conductors of the first group 18 are electrically connected at outer end 20 of the reeled cable to a first electrical clamp terminal 22 and the conductors of the second group 24 are connected to a second electrical clamp terminal 26 of opposite potential. The conductors of the first group are electrically connected to the conductors of the second group at the inner end 14 of the core by an electrically conductive clamp 28.

Figure 2:
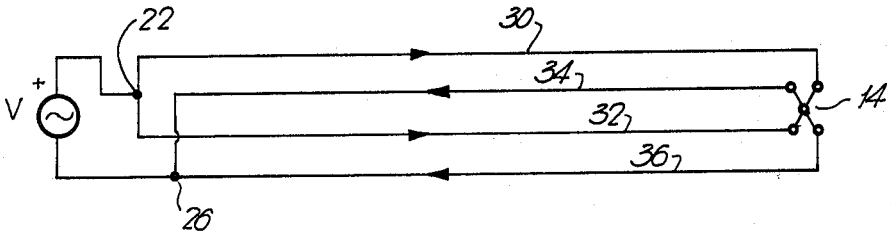
FIG. 2 is a part of the electrical circuitry used for passage of current through the reeled cable.

FIG. 2 shows part of the electrical circuit which is provided by the above connections. As shown in FIG. 2, paths 30, 32 represent the conductors in all of the pairs in the first group connected to clamp terminal 22 and lines 34, 36 represent the conductors in the pairs of the second group connected to terminal 26. The conductors are collectively connected together at the inner end 14 of the reel.

To heat up the insulated conductors, an AC current is passed along the path constituted by the first group of conductors in one direction around the reel to the inner end 14 and then through the second group of conductors in the opposite direction around the reel. It is found that with the conductors split equally between the two groups, hot spots (i.e. regions of conductor substantially hotter than elsewhere) are not created and a substantial uniform heating results. It is believed that a reason for this desirable result is the effect created by the opposing turns on the reel of the two groups of conductors.

If the number of conductors in the two groups is varied, the heating results are less desirable, with overall heating becoming more and more reduced as the differential between the numbers of conductors in the two groups increases. For instance, less desirable heating results are obtained if 60% of conductors are formed into one of the groups and 40% are in the other.

Similarly, where a DC current is fed through the reeled core for heating purposes, where the groups have equal numbers of conductors, then the opposing turns on the reel successfully cancel out any tendency for a magnetic field to be created around the core together with its attendant magnetizing effect. A magnetic field is created and increases in strength, however, as a differential is created and increased between the numbers of conductors in the two groups.

In a first embodiment, the cable core 10 has a length of 2250 ft and is composed of 600 pairs of 24 gauge conductor insulated in normal fashion. The two groups of conductors are each composed of 300 pairs of conductors (i.e. 600 conductors).

Figure 3:
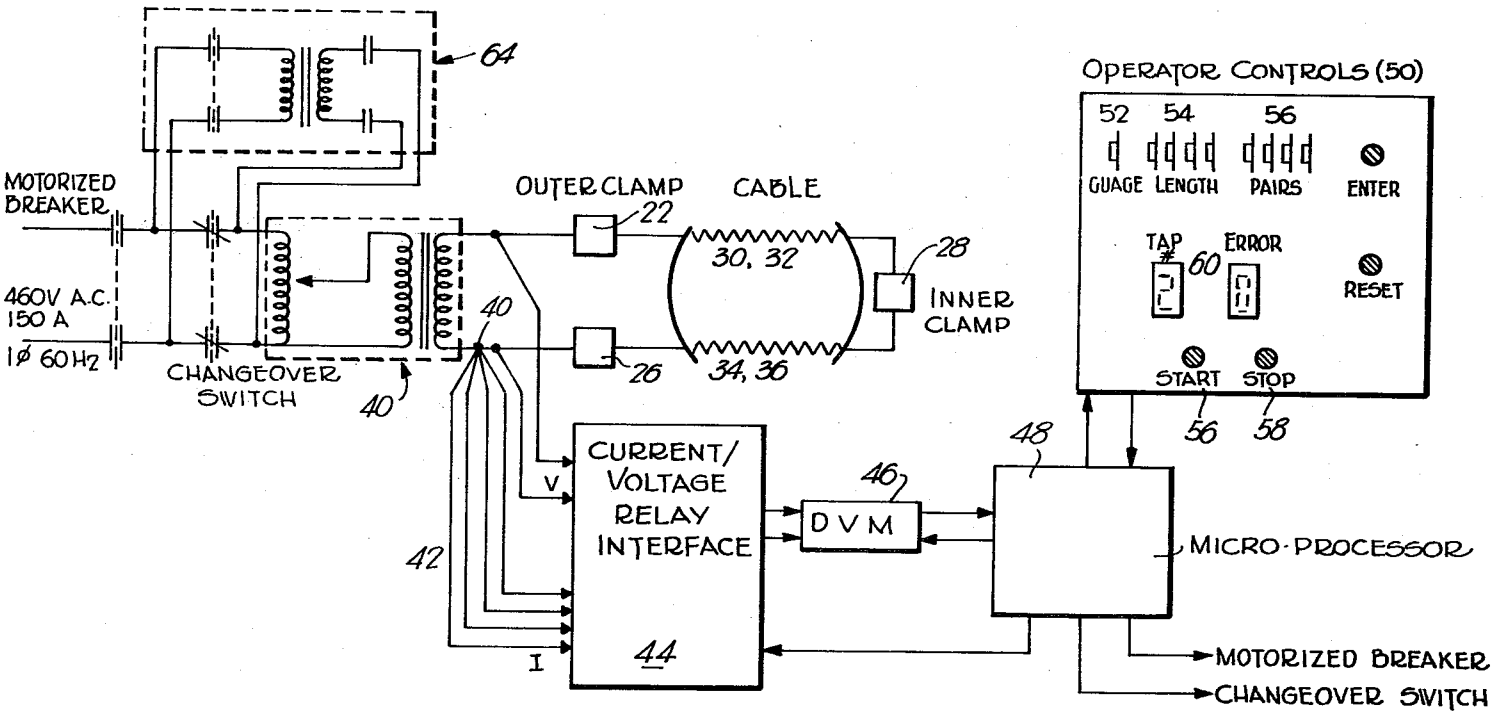
FIG. 3 is a more complete view of the circuit.

The heating of the reeled core is carried out automatically by the use of the equipment shown in FIG. 3. In FIG. 3, the cable is represented as two resistances, one designated 30, 32 for the conductors in the pairs of the first group connected between clamp terminal 22 and clamp 28 and the other designated 34, 36 for conductors of the second group connected between clamp 28 and clamp terminal 26.

The clamp terminals 22, 26 are connected to 440 volt AC mains by a step down transformer 40 having a position voltage tap to the terminals, and any one tap may be manually chosen. The tapped voltages are at 156 volts and 28.5 volts with six values in between.

There is also a current transformer in the line from the transformer to the clamp terminal 26. This has a four position tap with lines 42 to a current/voltage relay 44 for automatic selection of the appropriate ratio as will be described.

The relay 44 is equipped with a digital voltage meter 46 and is controlled by a microprocessor 48 to which information is fed from a manually operated panel 50 which is provided with switches in the form of a conductor gauge switch 52, reel length switches 54, the number of pairs of conductors, besides start and stop switches 56, 58. Also provided are indicator lights 60, one for each of the voltage tap positions, and controlled by the microprocessor.

To commence heating and after electrical connection of the reeled cable as described, the operator presses the appropriate buttons on panel 50 to convey to the microprocessor details of the cable to be heated, i.e. conductor gauge, reel length and number of conductor pairs. The microprocessor is provided with means to compute these details and select the current and voltage needed to heat the cable in the shortest time. A reading of the starting cable temperature is also transmitted to microprocessor to enable it to evaluate, with the cable measurements, the resistance of the cable at this temperature. If the computed voltage is outside the range provided by the transformer, an alarm is sounded or visually indicated at 62 on the panel.

However, if the voltage required is within the range, a signal is sent from the microprocessor to the appropriate indicator light 60 to inform the operator to select the required voltage tap on the transformer 40. The microprocessor itself selects the correct current tap.

Heating then commences. The equipment is provided with means to ensure that the correct voltage and current have been computed for the particular cable to be heated before full voltage is applied. This is a safeguard to prevent overheating of the conductor with an overload voltage and which could damage the cable. This ensuring means comprises a secondary transformer 64 which is automatically switched on by the microprocessor at the commencement of heating. This transformer 64 is capable of supplying only a percentage of the computed voltage for a short period to enable a comparison of cable resistances to be made. For this the relay is connected across the connections to clamp terminals 22 and 26. In this particular embodiment, the voltage applied through the secondary transformer is 5% of the selected voltage.

The relay reads the 5% voltage value and its accompanying current and feeds the information to the microprocessor where the actual resistance of the cable is then computed in the digital voltage meter and compared with the previously evaluated resistance which is retained in a memory store. If the actual and evaluated resistances do not compare favourably, then this can only mean that the original measurements fed into the microprocessor by the operator are incorrect and the alarm is operated. If, however, there is a favourable comparison, then the microprocessor switches on the transformer 40 and the selected tapped voltage is passed through the cable for heating purposes.

The microprocessor also has means to calculate the resistance of other cable at the temperature to which it is to be heated by evaluating it from the original information at the starting temperature. After computing this resistance value, it is retained in the memory store.

The applied current and voltage as applied to the cable are then read by the relay periodically as heating progresses and these values are continually used to compute the actual resistances of the cable at the increasing temperature. When one of these actual resistances is equal to the calculated resistance retained in the memory, then this indicates the cable has reached its required temperature. This temperature is between 55° C.–60° C. and it takes anywhere up to 100 mins. to be reached.

The heated core is now passed through the bath (not shown) of pressurized and heated filling grease, jelly or wax, the bath temperature of which is approximately 99° C. to enable it to flow under pressure. The heated filling substance flows through the interstices of the heated core to fill the core substantially completely and uniformly. Although the temperature of the filling substance will drop below its initial temperature upon contacting the cooler cable core, the heat transfer from the core will ensure that the substance does not fall below the core temperature. Thus, a degree of flowability of the substance is ensured to complete the filling operation and solidification and block of partially filled interstices is avoided. It has been found that after heating, the reeled core may be stored awaiting passage through the filling bath for a few hours without any substantial heat loss. Particularly, if the reeled core is covered in an insulating blanket after the heating process, the temperature drop is extremely small over a period of 2 or 3 hours and complete and uniform filling may still be accomplished.

The heating time required to bring a cable core up to the required temperature depends of course upon various factors apart from the electrical values, these factors including cable length, number of pairs and gauge of conductor.

For instance, in a second embodiment, the cable core is composed of 900 pairs of 26 gauge insulated conductors for a core length of 2250 ft. A current of approximately 0.52 amps AC is passed through each conductor for a period of about 48 minutes before the required core temperature of 65° C. for filling was obtained. The core is then filled in the same manner as that described in the first embodiment.

What is claimed is:

1. A method of treating a stranded construction of a plurality of similar stranded together insulated conductors in a core for telecommunications cable comprising:

having the core in a reeled condition with the core having two end portions accessibly positioned outside the reel;

forming the conductors into two groups with the number of conductors in a first of the groups being substantially equal to that in the second of the groups;

disposing the groups electrically in series with one another by electrically connecting the first and second groups together at one end of the core, electrically connecting the groups at the other end of the core, one to each of two terminals of opposite potential;

heating the core with it in the reeled condition by passing an AC single phase current from said other end to said one end of the core, along the first group of conductors in one direction around the reel, into and along the second group of conductors in the opposite direction around the reel from said one end to said other end of the core, heat in the conductors flowing into the insulation to increase the temperature at the outer surface of the insulation; and periodically measuring the current and voltage applied to the conductors and from these measurements determining the resistance of the conductors to provide a measurement of the temperature of the conductors; and unreeling the stranded construction and passing the unreeled construction through a chamber containing a flowable core filling substance, the flowability of which increases with an increase in temperature, the filling substance being caused to flow into the interstices beween the insulated conductors to fill the core, the heated core retaining a higher than ambient temperature in the filling substance to assist its flowability.

2. A method of treating a stranded construction according to claim 1 wherein the core comprises a plurality of insulated conductors, and in filling the core, the flowable substance flows into interstices in all of the core units and between the core units.

* * * * *